US005108104A

United States Patent [19]

Johnson

[11] Patent Number: 5,108,104

[45] Date of Patent: Apr. 28, 1992

[54] TRAINING DEVICE FOR GOLFER

[76] Inventor: Mark L. Johnson, 300 N. Rampart #26, Orange, Calif. 92668

[21] Appl. No.: 693,437

[22] Filed: Apr. 29, 1991

[51] Int. Cl.[5] ..... A63B 69/36

[52] U.S. Cl. ..... 273/183 B; 434/252

[58] Field of Search ..... 273/183 B, 190 R, 190 A, 273/190 B; 434/252

[56] References Cited

U.S. PATENT DOCUMENTS

| | | | |
|---|---|---|---|
| 3,025,064 | 3/1962 | Flood | 273/190 A X |
| 3,063,721 | 11/1962 | Jackson et al. | 273/190 A X |
| 3,109,654 | 11/1963 | Comitz | 273/183 B |
| 3,362,023 | 1/1968 | McMahon | 273/183 B |
| 3,808,707 | 5/1974 | Fink | 273/183 B X |
| 4,422,643 | 12/1983 | Cushing | 273/183 B |
| 4,789,159 | 12/1988 | Kane | 273/183 B |
| 4,883,276 | 11/1989 | Brown | 273/183 B |
| 4,896,375 | 1/1990 | Colucci | 2/12 |
| 5,005,835 | 4/1991 | Huffman | 273/183 B |

*Primary Examiner*—George J. Marlo

[57] ABSTRACT

A golf training device is provided that includes an attitude sensor, audible alarm, a power source, and associated electrical circuitry, all contained in a relatively small rotatable cylindrical enclosure. The device senses the orientation of the head of the golfer such that when the vertical axis of the golfer's head is coincident with a vertical orientation, a sensing device assumes a first state while otherwise the sensing device assumes a second state;

A timing device is connected with the sensing device such that as long as the sensing device assumes the first state, the timing device is inactive, while when the sensing device assumes the second state, a timing period is initiated, continuing until the timing period is completed, unless the sensing device again assumes the first state before the completion of the timing period whereupon the timing device again is inactive until the next incident when the sensing device assumes the second state;

An audible alarm is connected to the timing device, the alarm producing an alarm signal in response to the completion of the timing period; and the sensing device is mounted to move with the head of the golfer during the golf swing; whereby the timing period may be set such that minor movement of the head of the golfer which causes the vertical axis of the golfer's head to move out of the vertical orientation does not produce an alarm signal while a premature tilt of the head of the golfer greater than said minor movement during the golf swing will produce an alarm signal.

5 Claims, 4 Drawing Sheets

TRAINING DEVICE FOR GOLFER

FIELD OF THE INVENTION

This invention relates generally to training devices for the game of golf. More particularly, this invention relates to a device for training a golfer to maintain a head-down position during a golf swing.

BACKGROUND OF THE INVENTION

After hitting a golf ball in the game of golf, important visual feedback on the accuracy of the golf swing is obtained by observing the resulting course of the golf ball. It is tempting, therefore, for a golfer to raise his or her head to look up too early, specifically, either before or just as the golf club strikes the golf ball. This temptation frequently causes the golfer to incorrectly strike the golf ball, resulting in an errant shot. It is important, therefore, for the golfer to maintain a head-down position throughout the golf swing.

Several inventions exist for aiding a golfer in maintaining a head-down position while hitting a golf ball. In one prior example, a cap has an elongated visor with a visual indicator comprising a longitudinal line formed thereon. A golfer wearing this device visually aligns the golf ball with the longitudinal line during his golf swing, thereby making him conscious of any lifting or turning of his head. One considerable drawback of devices of this type is that the wearing of an akward elongated visor which, by design, extends significantly into the range of vision of the golfer hinders execution of other activities and, consequently, the visor must be removed often.

Another considerable drawback of devices of this type is that it is up to the golfer to constantly monitor his performance in keeping the visual indicator correctly aligned with the golf ball, and consequently use of this type of device may distract him from concentrating on the more important objective of hitting the golf ball properly. Disadvantageously, many prior inventions are active training devices, requiring the constant participation of the golfer before and during his swing to measure his performance. Moreover, those types of prior devices featuring a visual indicator are distracting to a golfer during his swing, especially since he is primarily relying on his visual senses to hit the golf ball accurately.

Similar drawbacks exist with previous other golfing aids, such as a device of the type having a level that rests in front of the golfer's face and is supported by the golfer's ears or head. Clearly such devices are distracting and obtrusive, not to mention somewhat awkward in appearance. Moreover, devices of this type are also active training devices, thereby disadvantageously requiring active monitoring by the golfer to be beneficial.

Another type of prior device extends downwardly from a visor and attempts to limit the golfer's sight lines by blocking the field of view of the golfer except for a peephole through which to view the golf ball. Such devices are certainly a hindrance when attempting to observe the path of the golf ball after hitting it. Moreover, such prior devices are also awkward in appearance and, perhaps as a result, are not widely used.

Many other prior harness devices have been invented to assist a golfer in keeping proper body alignment during a golf swing. Such devices typically are worn around the user's body and restrict improper movements with guide bars or the like. In general, however, these harnesses do not specifically help a golfer maintain a heads-down position throughout the critical moments of his or her swing.

There is a significant need, therefore, for a device that acts as a passive training aid, in that the golfer is only signalled when he has lifted his head. Otherwise, the needed device should require no active monitoring by the golfer. An improved passive training aid would permit the golfer to concentrate fully on the golf shot at hand, would not rely on visual feedback (which could create distractions), and would be as unobtrusive and subtle in appearance as possible. It is important that such an improved training aid should not handicap the golfer in any way. The present invention fulfills these needs and provides further related advantages.

SUMMARY OF THE INVENTION

The present invention is a passive training device for helping a golfer learn to maintain a head-down position during a golf swing. A small enclosure contains a mercury filled electrical switch, an audible alarm such as a piezo buzzer, circuitry for sounding the audible alarm, and a battery. The device is small enough to be clipped onto eyeglasses, attached to a hat or headband, or any other article worn on the head of the golfer. When activated via a power switch, the device sounds the audible alarm if the mercury switch detects that the golfer has raised his head for a significant length of time. A sensitivity adjustment for the mercury switch is included to accommodate various skill levels of the golfer. A small battery powers the circuitry.

In operation, the golfer activates the device before he swings the golf club. During his golf swing, if the golfer lifts his head too early, he will hear the piezo buzzer sound and become alerted to the fact that he has lifted his head too early. This feedback will help train the golfer to maintain a head-down position during a golf swing while allowing full concentration on swinging the golf club correctly. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 2:
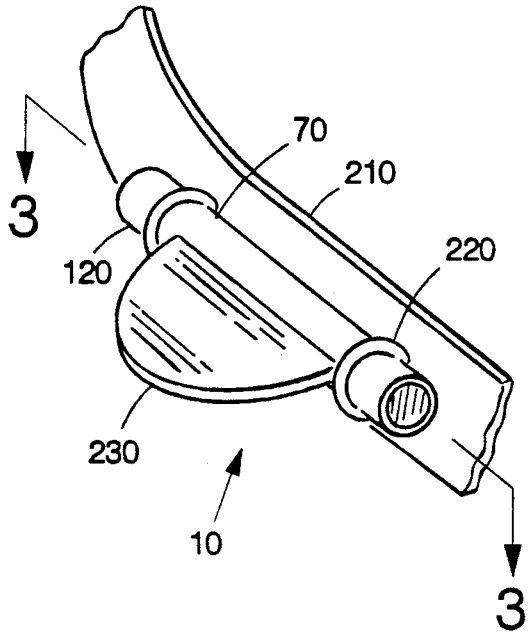
FIG. 2 is an enlarged perspective view showing the device of FIG. 1 with further detail, with said invention shown attached to a visor (depicted in fragment)
Figure 1:
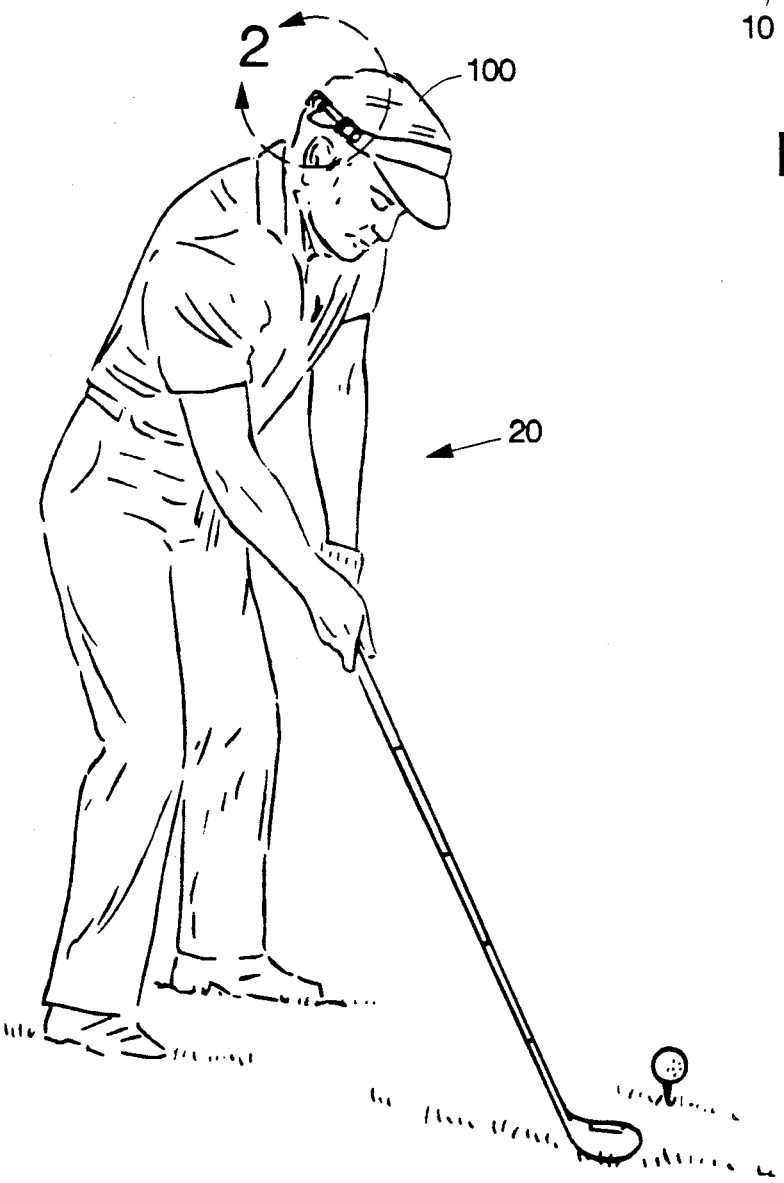
FIG. 1 is a perspective view of a golf training device embodying the invention, with said device depicted as it is used by a golfer.
Figure 3:
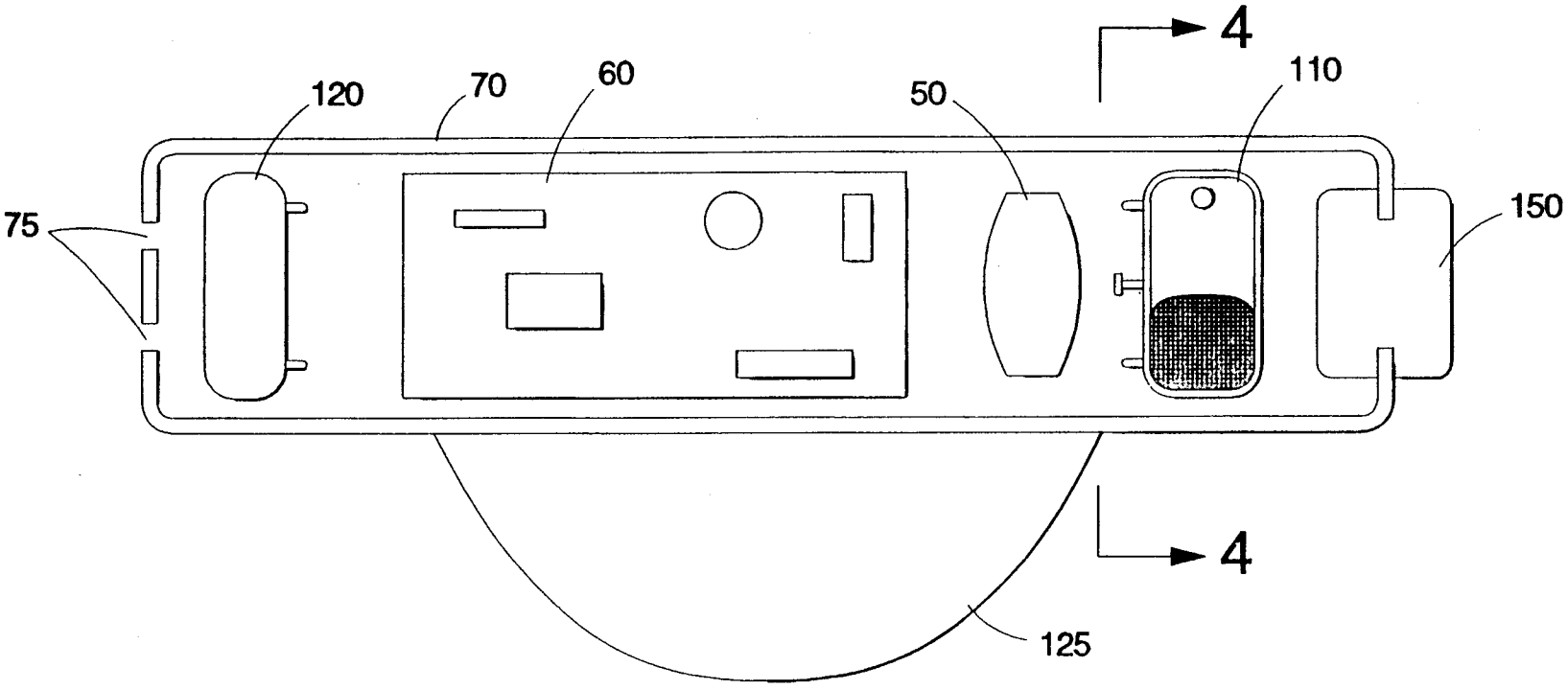
FIG. 3 is an enlarged top plan cross-sectional view of the invention taken generally along lines 3—3 of FIG. 2, illustrating internal components of the invention.
Figure 4A:
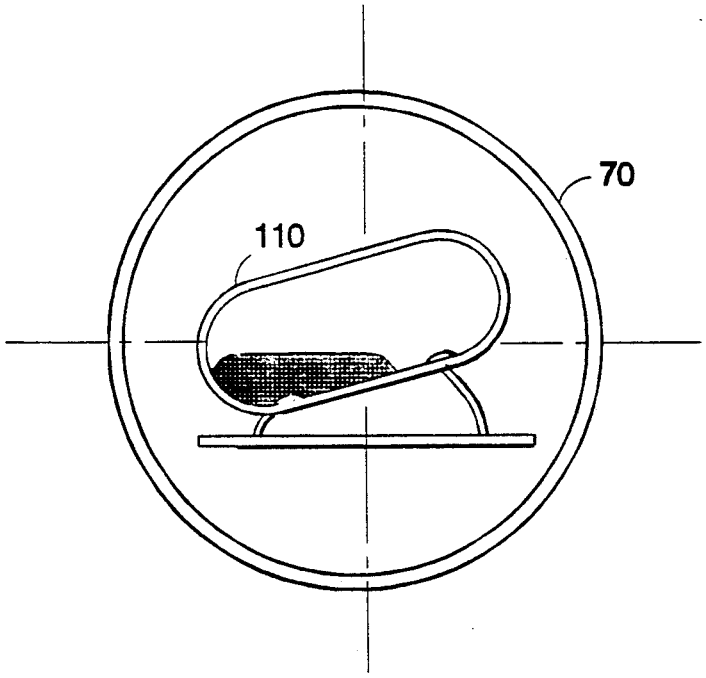
FIG. 4A is a cross-sectional view of the invention of FIG. 3 taken generally along line 4—4 of FIG. 3, illustrating the state of a mercury switch of the invention when the golfer is in a head-down position and the switch is open.
Figure 4B:
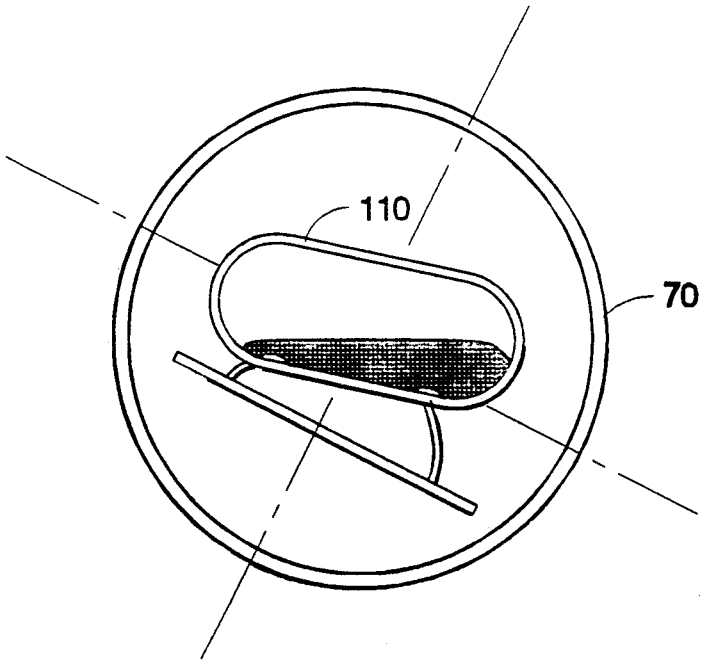
FIG. 4B is a cross-sectional view of the invention similar to FIG. 4A taken generally along line 4—4 of FIG. 3, illustrating the state of the mercury switch of the invention when the golfer is in a head-up position and the switch is closed by the mercury.
Figure 5:
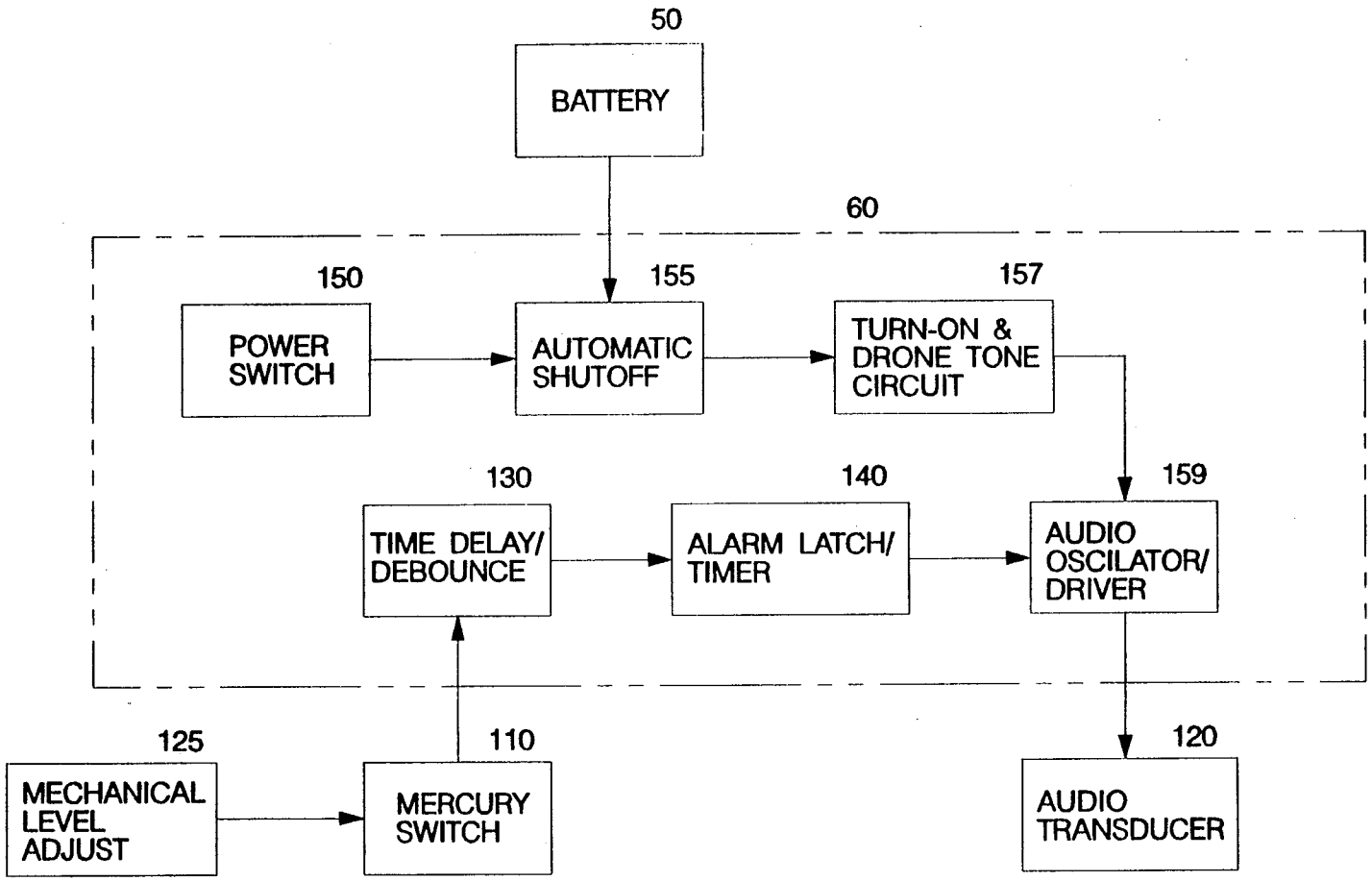
FIG. 5 is a schematic diagram of an electrical circuit of the invention.

FIGS. 1 and 2 illustrate a training device 10 for helping a golfer 20 learn to maintain a head-down position during a golf swing. FIG. 3 illustrates the components of the training device 10. An attitude sensing means, preferably a mercury switch 110 (FIGS. 4A and 4B), is interconnected to an electrical circuit 60 (FIG. 5). The electric circuit 60 is further interconnected to an audible alarm, such as a piezo buzzer 120, and a power source 50.

The electrical circuit 60 preferably includes a timing means 130, a power switching means 140, a power switch 150, an automatic shutoff function 155, a turn-on and drone tone circuit 157, and an audio oscilator/-driver 159 (FIG. 5). The timing means 130 allows a time delay between closing of the mercury switch 110 and the sounding of the piezo buzzer 120. A timer circuit in the power switching means 140 ensures that the piezo buzzer 120 remains energized for a sufficient time once activated, the timer circuit having an electrical resistor in series with an electrical capacitor (not shown). The power switch 150, preferably, is a touch-activated momentary contact switch.

Once the circuit 60 is activated through the power switch 150, the automatic shutoff 155 deactivates the circuit 60 after a predetermined period of time so as to prevent excess energy loss from the battery 50. The turn-on and drone tone circuit 157, upon activation of the circuit 60, momentarily activates the auido oscilator/driver 159, which in turn activates the audio transducer 120, so as to signal the golfer 20 that the device 10 has been activated and is ready for use. The audio oscilator/driver 159 also activates the audio transducer 120 when power is applied to the audio oscilator/driver 159 from the power switching means 140.

Enclosure body 70 defines a relatively small volume that encloses the mercury switch 110, the piezo buzzer 120, the power source 50, and the electrical circuit 60. The enclosure body 70 may be made from any rigid material, such as plastic, that is lightweight so as to not hinder the golfer 20, and that is resistant to the effects of prolonged exposure to weather elements. The enclosure body 70 has holes 75 (FIG. 3) therein to allow sound from the piezo buzzer 120 to emanate therethrough.

A pair of encircling bands 220 supports the enclosure body 70 on a head 100 of the golfer 20 in fixed longitudinal orientation, either by attachment with conventional means to eyeglasses (not shown), the band 210 of a hat or visor (FIG. 2), or any other article worn or attached to the head 100 of the golfer 20. The bands 220 allow the enclosure 70 to rotate freely about the longitudinal axis thereof. A mechanical attitude sensor adjustment means 125, preferably a protrusion 230 (FIG. 2) from the enclosure 70, allows the calibration of the mercury switch 110 to a preferred rotational position.

In operation, the golfer 20 attaches the training device 10 to an article worn on his head 100, such as the band 210 of a hat. The golfer 20 manually activates the power switch 150 and adjusts the protrusion 230 such that when he is maintaining a normal, comfortable head-down position, such as when looking at a golf ball at his feet, the piezo buzzer 120 is not active. This adjustment of the protrusion 230 should also be such that shortly after he raises his head 100, as when looking after a golf ball that has just been hit, the piezo buzzer 120 is activated. He then performs a golf swing, hitting a golf ball in a normal manner. If the piezo buzzer 120 is activated during the golf swing, the golfer 20 is alerted that he has raised his head 100 too early after initiating the golf swing. In this way, the golfer 20 receives passive feedback as about his golf swing, and, as a result, may improve his golf swing.

While the invention has been described with reference to a preferred embodiment, it is to be clearly understood by those skilled in the art that the invention is not limited thereto. For example, it will be clear to anyone skilled in the art that a more complex electrical circuit 60 could be included that, after a delay, automatically deactivates the piezo buzzer 120 and, for example, resets itself after the golfer has maintained a head-down position for a length of time. Other modification to the invention are recognized as being within the spirit and scope of the invention. Accordingly, it is not intended that the invention be limited, except as by the appended claims.

What is claimed is:

1. A device for training a golfer, during a golf swing, to maintain the vertical axis of the head of the golfer in a vertical orientation, comprising:

an attitude sensing means for orientation sensing, the sensing means being sensitive to the orientation of the head of the golfer such that when the vertical axis of the golfer's head is coincident with a vertical orientation the sensing means assumes a first state while otherwise the sensing means assumes a second state;

a timing means, the timing means being connected with the sensing means such that as long as the sensing means assumes the first state the timing means is inactive, while when the sensing means assumes the second state, a timing period is initiated, continuing until the timing period is completed, unless the sensing means again assumes the first state before the completion of the timing period whereupon the timing means again is inactive until the next incident when the sensing means assumes the second state;

an audible alarm connected to the timing means, means for enabling the alarm to produce an alarm signal in response to the completion of said timing period; and means for mounting the sensing means onto the golfer such that the sensing means moves with the head of the golfer during the golf swing; whereby the timing period may be set such that minor movement of the head of the golfer which causes the vertical axis of the head to move out of the vertical orientation does not produce an alarm signal, while movement of the head of the golfer greater than said minor movement during the golf swing will produce an alarm signal.

2. The device of claim 1 further including a means for circuit interruption delay, the delay means continuing to hold the circuit open after the switching means has closed, for a set amount of time so that the alarm means is not activated unless movement of the golfer's head away from the preferred position continues for a period of time longer than the set amount of time.

3. The device of claim 1 wherein the mounting means includes an enclosure and permits the enclosure to be rotated over a range of fixed desired orientations whereby sensitivity of the switching means to movement of the golfer's head is adjustable.

4. The device of claim 1 wherein the audible alarm is an audible transducer.

5. The device of claim 1 further including a means for generating a tone, the tone means having a switch for starting the tone.

* * * * *